US010842344B2

(12) United States Patent
Kim et al.

(10) Patent No.: US 10,842,344 B2
(45) Date of Patent: Nov. 24, 2020

(54) DISHWASHER AND CONTROL METHOD THEREOF

(71) Applicant: LG Electronics Inc., Seoul (KR)

(72) Inventors: Seunghun Kim, Seoul (KR); Sangwoo Woo, Seoul (KR)

(73) Assignee: LG Electronics Inc., Seoul (KR)

( * ) Notice: Subject to any disclaimer, the term of this patent is extended or adjusted under 35 U.S.C. 154(b) by 196 days.

(21) Appl. No.: 15/747,355

(22) PCT Filed: Jul. 18, 2016

(86) PCT No.: PCT/KR2016/007778
§ 371 (c)(1),
(2) Date: Jan. 24, 2018

(87) PCT Pub. No.: WO2017/022975
PCT Pub. Date: Feb. 9, 2017

(65) Prior Publication Data

US 2018/0213998 A1 Aug. 2, 2018

(30) Foreign Application Priority Data

Aug. 3, 2015 (KR) ..... 10-2015-0109608

(51) Int. Cl.
*A47L 15/00* (2006.01)
*A47L 15/42* (2006.01)

(52) U.S. Cl.
CPC ..... *A47L 15/0015* (2013.01); *A47L 15/0013* (2013.01); *A47L 15/0034* (2013.01);
(Continued)

(58) Field of Classification Search
CPC ..... A47L 15/0034; A47L 15/4221; A47L 15/4225; A47L 15/4285; A47L 15/0013;
(Continued)

(56) References Cited

U.S. PATENT DOCUMENTS

2008/0295865 A1* 12/2008 Ahn ..... A47L 15/0015 134/18
2009/0025754 A1* 1/2009 Choi ..... A47L 15/0015 134/18

(Continued)

FOREIGN PATENT DOCUMENTS

DE 102006025150 A1 12/2006
DE 102006025152 A1 12/2006

(Continued)

OTHER PUBLICATIONS

Machine Translation of EP 1738677A2 to Gau et al., Jan. 2007. (Year: 2007).*

(Continued)

*Primary Examiner* — Benjamin L Osterhout
(74) *Attorney, Agent, or Firm* — Fish & Richardson P.C.

(57) ABSTRACT

Disclosed is a control method of a dishwasher (100) including a tub (2) for receiving objects to be washed, a plurality of spray arms (711, 713, 715) for spraying wash water to the objects, and a steam nozzle (42) for spraying steam to the objects, the control method including a main washing cycle of washing the objects, a rinsing cycle of rinsing the washed objects using wash water, and a drying cycle of drying the objects after the rinsing is completed, wherein the drying cycle includes spraying steam, received from a steam source, to the objects to increase a temperature of the objects (a steam spraying step) and resupplying water to the steam source in order to prevent the steam source from being heated after the steam spraying step (a cooling step).

14 Claims, 9 Drawing Sheets

(52) U.S. Cl.
CPC ..... *A47L 15/0047* (2013.01); *A47L 15/4221* (2013.01); *A47L 15/4225* (2013.01); *A47L 15/4234* (2013.01); *A47L 15/4285* (2013.01); *A47L 15/0036* (2013.01); *A47L 15/4257* (2013.01); *A47L 2401/04* (2013.01); *A47L 2501/14* (2013.01); *A47L 2601/04* (2013.01); *A47L 2601/20* (2013.01)

(58) Field of Classification Search
CPC ..... A47L 15/0047; A47L 15/4234; A47L 15/0015; A47L 15/4257; A47L 2401/04; A47L 15/0036; A47L 2501/14; A47L 2601/04; A47L 2601/20
See application file for complete search history.

(56) References Cited

U.S. PATENT DOCUMENTS

2009/0056752 A1* 3/2009 Han ..... A47L 15/0015 134/10
2009/0235957 A1* 9/2009 Kim ..... A47L 15/0007 134/25.2
2011/0247666 A1* 10/2011 Fiora ..... A47L 15/0015 134/56 D
2012/0055517 A1 3/2012 Yoo

FOREIGN PATENT DOCUMENTS

| | | | | |
|---|---|---|---|---|
| DE | 102008025207 | A1 | 12/2009 | |
| EP | 1738677 | A2 * | 1/2007 | ..... A47L 15/0005 |
| EP | 1842476 | A1 | 10/2007 | |
| EP | 2156775 | | 2/2010 | |
| EP | 2604165 | A1 | 6/2013 | |
| KR | 857803 | A1 | 9/2008 | |
| KR | 2009118608 | A1 | 11/2009 | |
| KR | 20130070275 | A1 | 6/2013 | |
| KR | 1481566 | A1 | 1/2015 | |
| WO | WO2008147033 | A1 | 12/2008 | |

OTHER PUBLICATIONS

International Search Report and Written Opinion in International Application No. PCT/KR2016/007778, dated Nov. 9, 2016, 10 pages.
Partial Supplementary European Search Report in European Application No. 16833211.2, dated Mar. 7, 2019, 15 pages.

* cited by examiner

[Fig. 1]
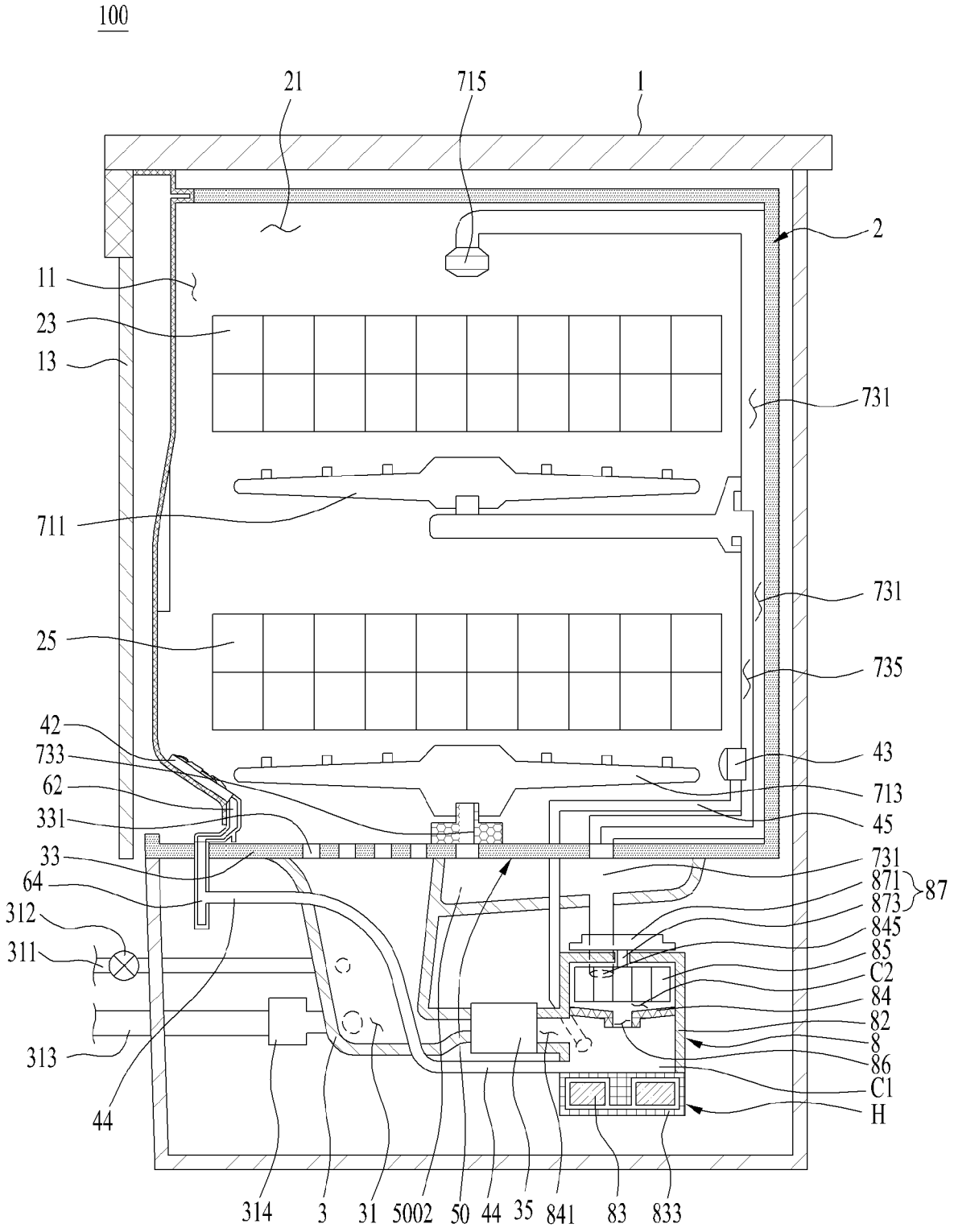

[Fig. 2]
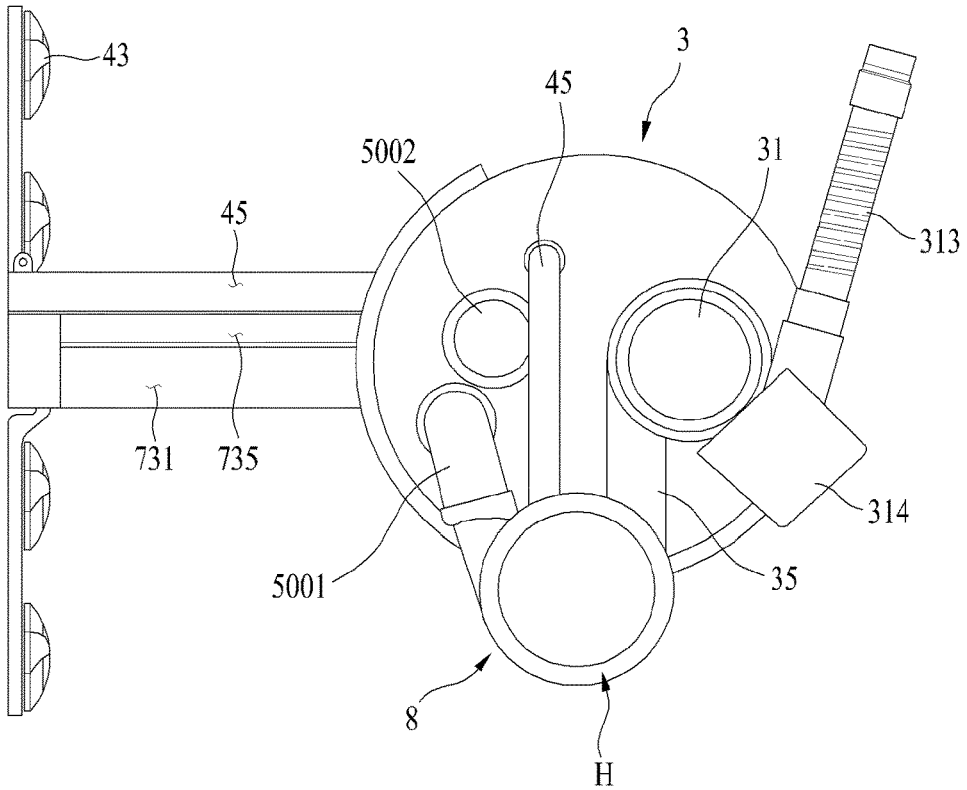
[Fig. 3]
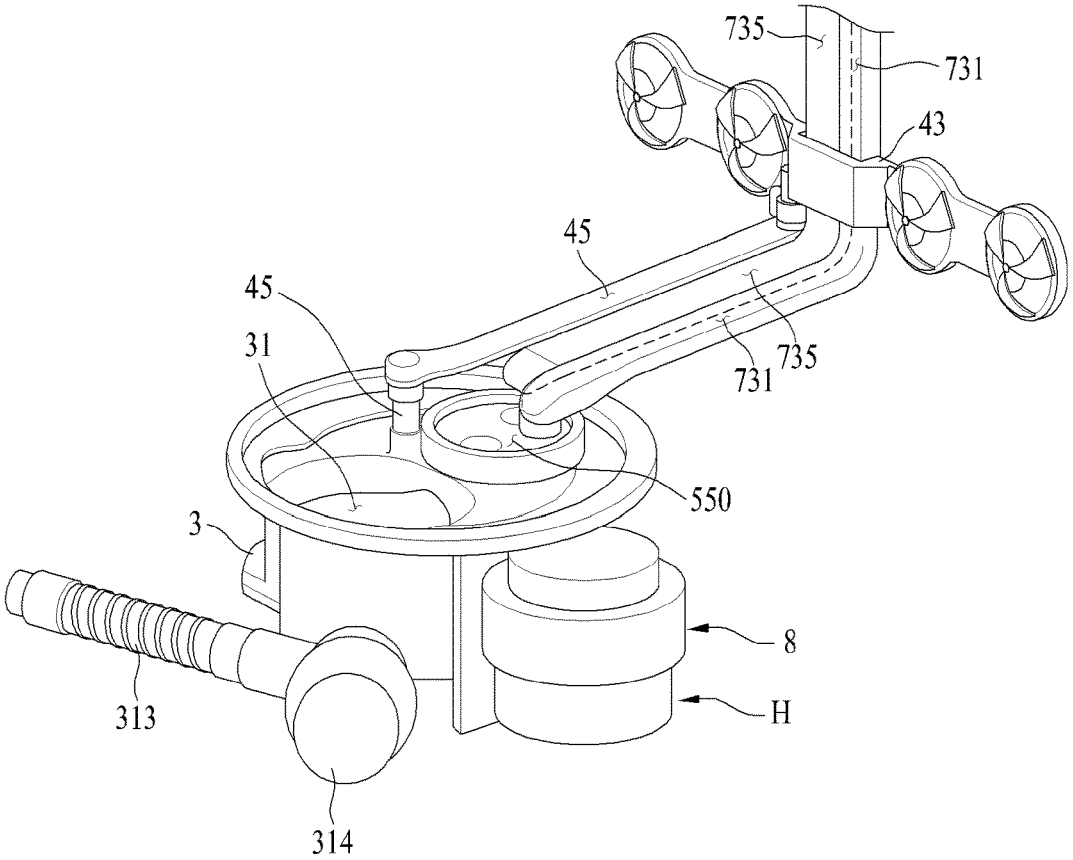

[Fig. 4]
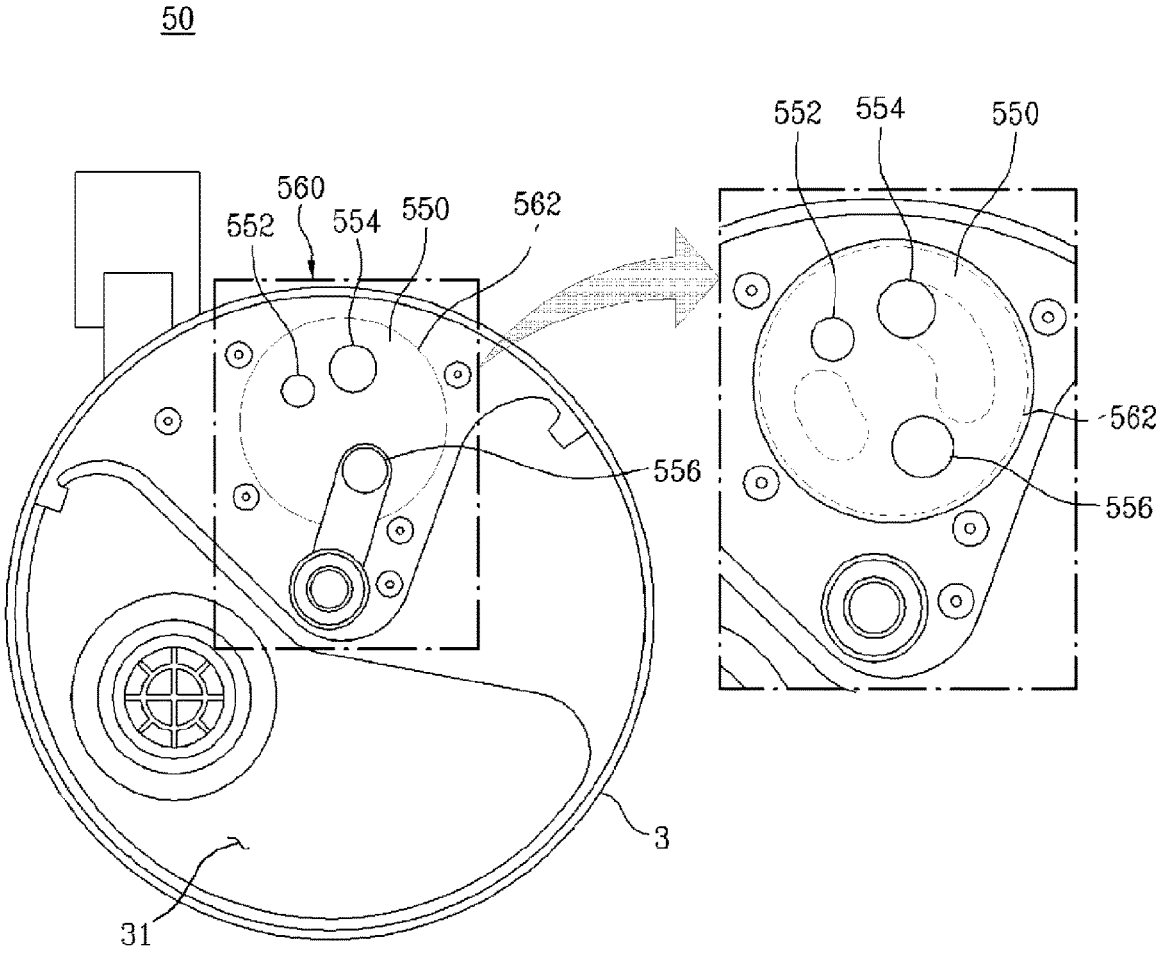

[Fig. 5]
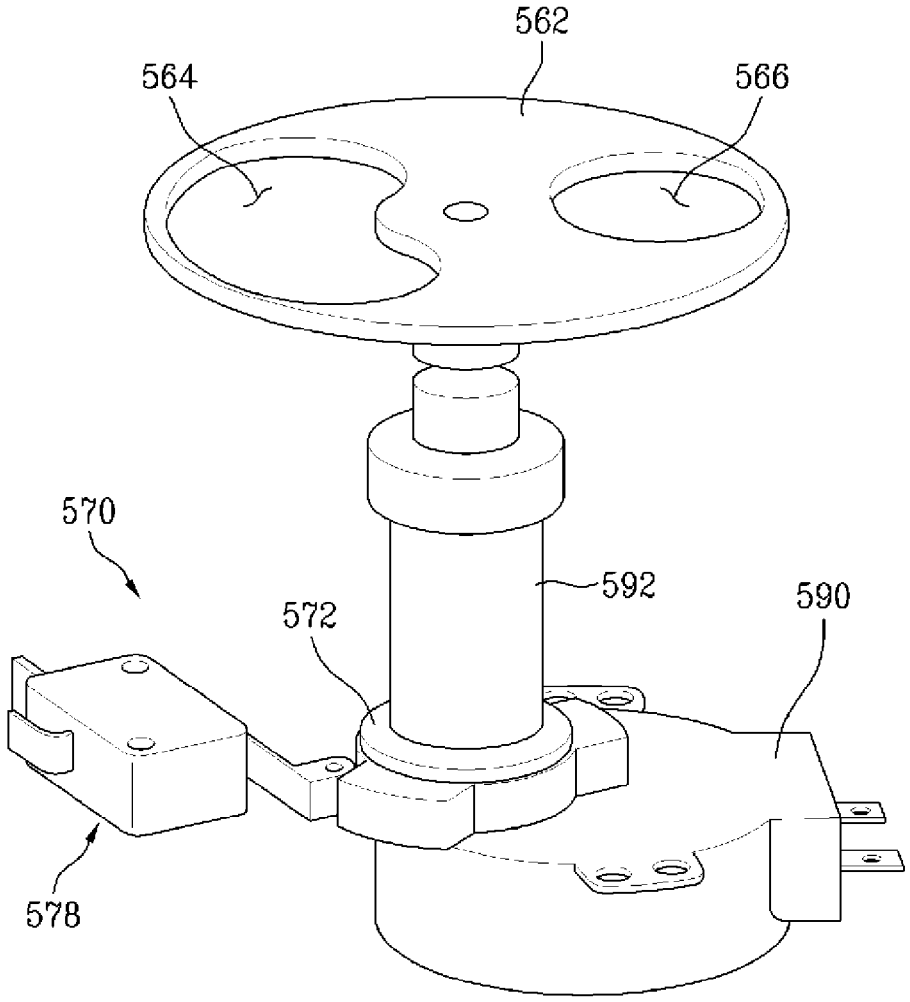

[Fig. 6]
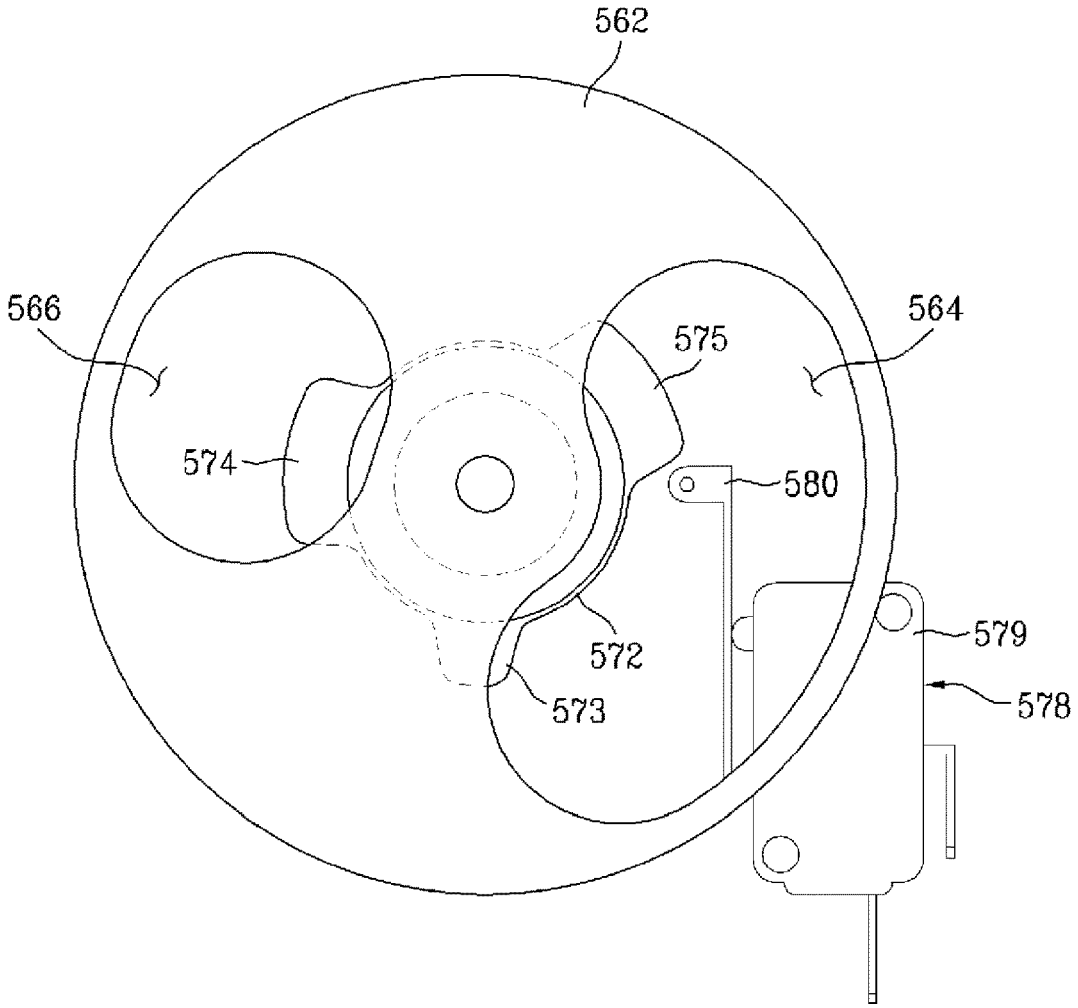
[Fig. 7]
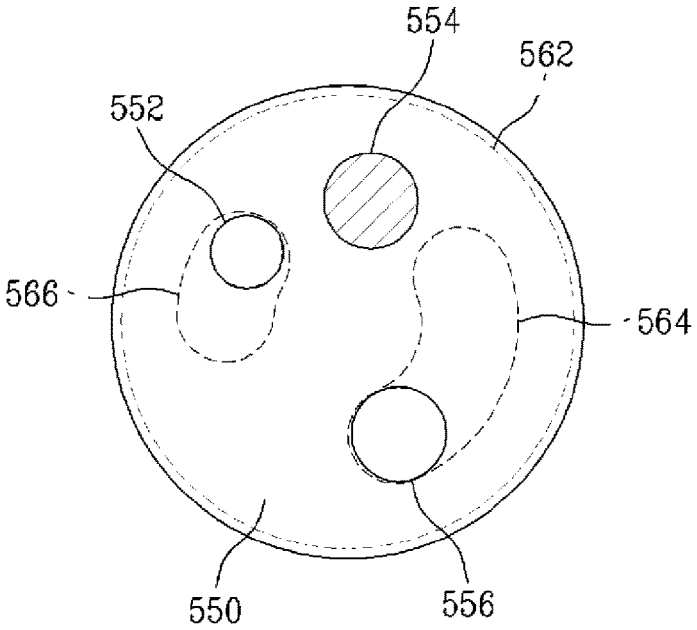

[Fig. 8]
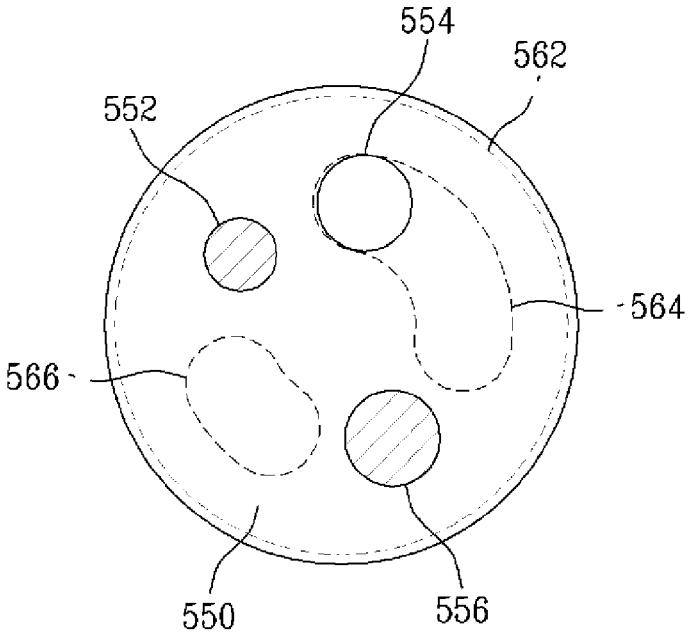
[Fig. 9]
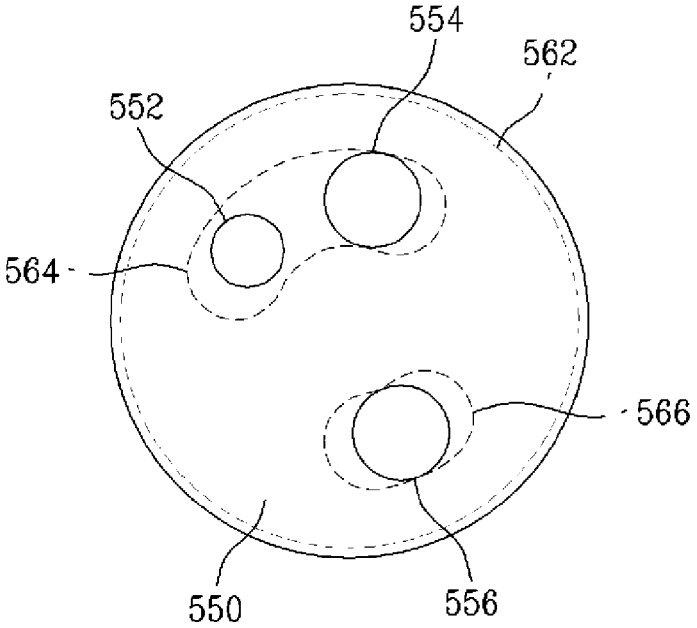

[Fig. 10]
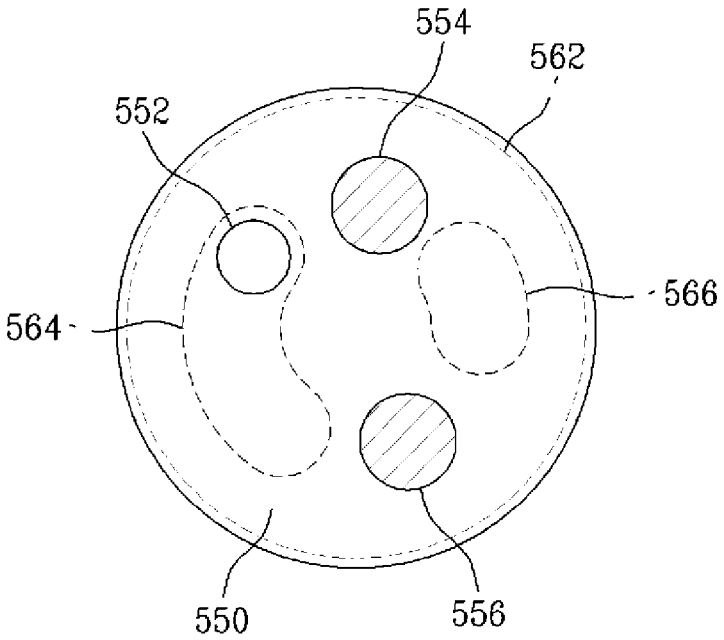
[Fig. 11]
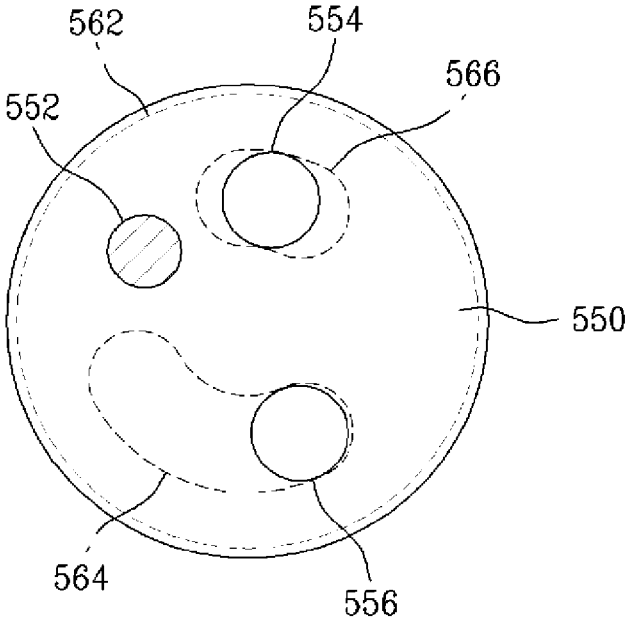

[Fig. 12]
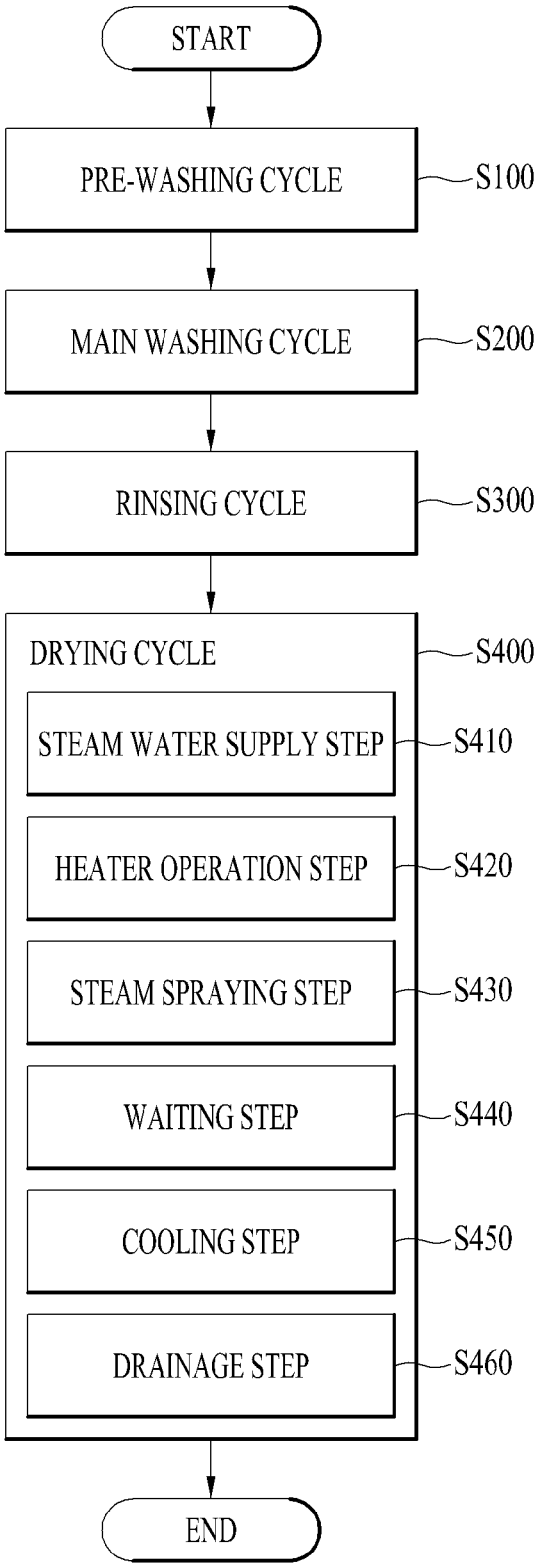

[Fig. 13]
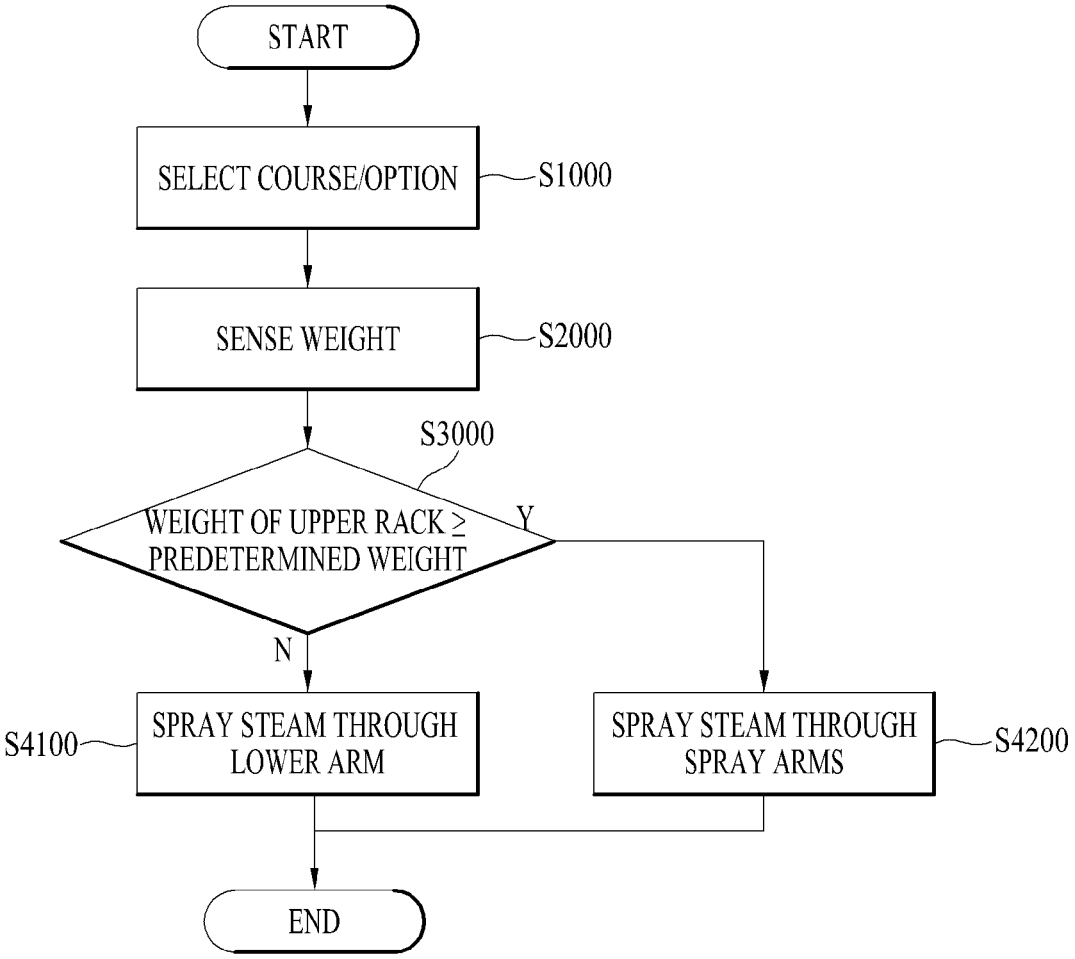

DISHWASHER AND CONTROL METHOD THEREOF

CROSS-REFERENCE TO RELATED APPLICATIONS

This application is a National Stage application under 35 U.S.C. § 371 of International Application No. PCT/KR2016/007778, filed on Jul. 18, 2016, which claims the benefit of Korean Application No. 10-2015-0109608, filed on Aug. 3, 2015. The disclosures of the prior applications are incorporated by reference in their entirety.

TECHNICAL FIELD

The present invention relates to a dishwasher and a control method thereof, and more particularly to a dishwasher capable of spraying steam through a spray arm and a method of controlling a dishwasher that sprays steam to perform a drying cycle.

BACKGROUND ART

A dishwasher is an electric home appliance machine that sprays wash water onto objects to be washed in order to remove foreign matter from the objects.

A conventional dishwasher generally includes a tub that defines a washing space, a rack provided in the tub for receiving objects to be washed, a spray arm for spraying wash water to the rack, a sump for storing wash water, and a pump for supplying the wash water stored in the sump to the spray arm.

Meanwhile, some examples of the conventional dishwasher are configured to wash objects to be washed using heated wash water or to supply steam to objects to be washed in order to wash or sterilize the objects.

The conventional dishwasher further includes a steam generator for generating steam and a steam nozzle for spraying the steam, generated by the steam generator, to the tub.

In addition, the conventional dishwasher uses an algorithm of performing a final rinsing cycle after a rinsing cycle is completed, and spraying heated wash water through the spray arm in the final rinsing cycle such that the temperature of dishes are increased, thereby increasing washing force and achieving rapid drying. Subsequently, a waiting time is generally allocated for the wash water on the dishes to vaporize due to the temperature of the dishes and such that a user does not burn his/her hands when taking the dishes out of the dishwasher.

Since the heated wash water is sprayed through the spray arm in the final rinsing cycle, however, the amount of water that is supplied is increased.

DISCLOSURE OF INVENTION

Technical Problem

An object of the present invention devised to solve the problem lies on a dishwasher that is capable of spraying steam through a spray arm and a control method thereof.

Another object of the present invention devised to solve the problem lies on a dishwasher that uses a smaller amount of water than when spraying heated water through a spray arm in order to perform a drying cycle and that is capable of completing the drying cycle within a short time and a control method thereof.

Another object of the present invention devised to solve the problem lies on a dishwasher that is capable of reducing the time necessary to increase the temperature of dishes in order to reduce energy consumption and to achieve rapid drying and that is capable of reducing the amount of water that is used and a control method thereof.

A further object of the present invention devised to solve the problem lies on a dishwasher that is capable of preventing damage to a heater and the reduction of the lifetime of the heater as the result of the heater being heated due to the use of steam for a long time and a control method thereof.

Solution to Problem

The object of the present invention can be achieved by providing a control method of a dishwasher, including a tub for receiving objects to be washed, a plurality of spray arms for spraying wash water to the objects, and a steam nozzle for spraying steam to the objects, the control method including a main washing cycle of washing the objects, a rinsing cycle of rinsing the washed objects using wash water, and a drying cycle of drying the objects after the rinsing is completed, wherein the drying cycle includes spraying steam, received from a steam source, to the objects to increase the temperature of the objects (a steam spraying step) and resupplying water to the steam source in order to prevent the steam source from being heated after the steam spraying step (a cooling step).

The rinsing cycle may include spraying room-temperature wash water to the objects in order to rinse the objects (a final rinsing step).

In the case in which the objects are rinsed using heated wash water in the rinsing cycle, a pause period may be provided for a predetermined time after the rinsing cycle.

The steam spraying step may be performed for a predetermined time.

Steam may be intermittently sprayed at the steam spraying step.

The drying cycle may include supplying water necessary to generate steam to the steam source (a steam water supply step) and supplying power to a heater to generate steam (a heater operation step).

The drying cycle may further include providing a pause period such that the steam sprayed to the objects is vaporized after the steam spraying step (a waiting step).

The steam source may include a sump for storing wash water and a sump heater provided in the sump.

The steam source may include a sump for storing wash water, a pump for supplying the wash water stored in the sump to the spray arms, and a pump heater provided in the pump.

At the cooling step, a wait may be performed for a predetermined time after the water is resupplied.

The drying cycle may further include discharging water from the steam source after the cooling step (a drainage step).

The steam spraying step may include spraying steam through the steam nozzle (a first steam spraying step) and spraying steam through at least one of the spray arms (a second steam spraying step).

The control method may further include selecting a predetermined course or option (a course/option selection step), wherein the course/option selection step may include selecting at least one from among a first course, in which the first steam spraying step is performed in the drying cycle, a second course, in which the second steam spraying step is performed in the drying cycle, a third course, in which the first steam spraying step and the second steam spraying step are performed simultaneously, and a fourth course, in which the first steam spraying step and the second steam spraying step are performed sequentially.

The control method may further include sensing the weight of an upper rack, in which the objects are placed (a weight sensing step), wherein, when the weight of the upper rack is equal to or greater than a predetermined weight, both the first steam spraying step and the second steam spraying step may be performed.

When the weight of the upper rack is less than the predetermined weight, only the first steam spraying step may be performed.

In another aspect of the present invention, provided herein is a dishwasher including a cabinet, a tub provided in the cabinet for receiving objects to be washed, a plurality of spray arms for spraying wash water to the objects, a sump for storing wash water, a pump for supplying the wash water stored in the sump to the spray arms, a distribution unit for selectively supplying the wash water, supplied by the pump, to at least one of the spray arms, and a pump heater provided in the pump for generating steam, wherein the steam generated by the pump heater is selectively supplied to at least one of the spray arms via the distribution unit.

The distribution unit may include a rotary member rotatably provided on the lower surface of the tub and openings provided in the rotary member so as to selectively communicate with supply paths connected to the spray arms, a space communicating with the pump for storing wash water or steam may be defined under the distribution unit, and the wash water or steam stored in the space may be selectively supplied to the spray arms through the openings as the result of the rotation of the rotary member.

The dishwasher may further include a steam path connected to the pump and a steam nozzle provided in the tub.

Advantageous Effects of Invention

The present invention has the effect of providing a dishwasher that is capable of spraying steam through a spray arm and a control method thereof.

In addition, the present invention has the effect of providing a dishwasher that uses a smaller amount of water than when spraying heated water through a spray arm in order to perform a drying cycle and that is capable of completing the drying cycle within a short time and a control method thereof.

In addition, the present invention has the effect of providing a dishwasher that is capable of reducing the time necessary to increase the temperature of dishes in order to reduce energy consumption and to achieve rapid drying and that is capable of reducing the amount of water that is used and a control method thereof.

In addition, the present invention has the effect of providing a dishwasher that is capable of preventing damage to a heater and the reduction of the lifetime of the heater as the result of the heater being heated due to the use of steam for a long time and a control method thereof.

BRIEF DESCRIPTION OF DRAWINGS

The accompanying drawings, which are included to provide a further understanding of the invention, illustrate embodiments of the invention and together with the description serve to explain the principle of the invention.

In the drawings:

FIG. 1 is a view showing an example of a dishwasher according to the present invention;

FIG. 2 is a view showing the lower part of the dishwasher according to the present invention;

FIG. 3 is a perspective view showing a sump, a pump, and supply paths provided in the dishwasher according to the present invention;

FIG. 4 is a plan view showing a sump of the present invention;

FIG. 5 is a perspective view showing a distribution unit of the present invention;

FIG. 6 is a plan view showing the distribution unit of the present invention;

FIGS. 7 to 11 are views showing the relationship between a rotary member and communication holes of the present invention;

FIG. 12 is a flowchart showing an example of a method of controlling a dishwasher according to the present invention; and FIG. 13 is a flowchart showing an example of a method of spraying steam through spray arms in the method of controlling the dishwasher according to the present invention.

BEST MODE FOR CARRYING OUT THE INVENTION

Reference will now be made in detail to the preferred embodiments of the present invention, examples of which are illustrated in the accompanying drawings.

All terms disclosed in this specification correspond to general terms understood by persons having ordinary skill in the art to which the present invention pertains unless the terms are specially defined. If the terms disclosed in this specification conflict with general terms, the terms may be understood on the basis of their meanings as used in this specification.

It should be noted herein that the construction and control method of a device which will hereinafter be described are given only for illustrative purposes, and that the protection scope of the invention is not limited thereto. Wherever possible, the same reference numbers will be used throughout the drawings to refer to the same or like parts.

The present invention relates to a dishwasher that is capable of spraying steam from the front or the rear of a tub. FIG. 1 is a view showing an example of a dishwasher according to the present invention. FIG. 2 is a view showing the lower part of the dishwasher according to the present invention. FIG. 3 is a perspective view showing a sump, a pump, and supply paths provided in the dishwasher according to the present invention.

As shown in FIGS. 1 and 2, the dishwasher, denoted by reference numeral 100, may include a cabinet 1, a tub 2 provided in the cabinet 1 for receiving objects to be washed, spray arms 711, 713, and 715 for spraying wash water to the objects, a sump 3 for storing wash water, and a door 13 for opening and closing an opening 11 formed in the cabinet 1.

The cabinet 1 defines the external appearance of the dishwasher. The opening 11 is formed in one side of the cabinet 1. The opening 11 communicates with the interior of the tub 2.

A washing space 21 is defined in the tub 2. Racks, in which the objects are received, may be provided in the washing space 21. The racks may include an upper rack 23 provided in the upper part of the tub 11 and a lower rack 25 provided below the upper rack 23.

The tub 2 is opened and closed by the door 13, which is provided at one surface of the cabinet 1 such that a user opens the door 13 and withdraws the upper rack 23 and the lower rack 25 from the tub 2.

In the case in which the racks include the upper rack 23 and the lower rack 25, the spray arms 711, 713, and 715 may include an upper arm 711 for spraying wash water to the upper rack 23 from under the upper rack 23, a lower arm 713 for spraying wash water to the lower rack 25 from under the lower rack 25, and a top arm 715 for spraying wash water to the upper rack 23 from above the upper rack 23.

The wash water sprayed to the objects by the spray arms 711, 713, and 715 may be collected in the sump 3.

The sump 3 includes a first storage unit 31 provided under the tub 2 to store wash water. The first storage unit 31 stores wash water containing foreign matter removed from the objects.

The sump 3 is provided at the top thereof with a sump cover 33, by which the sump 3 is partitioned from the tub 2. In this case, the sump cover 33 may be provided with a collection hole 331, through which the interior of the tub 2 communicates with the interior of the sump 3.

Meanwhile, the sump 3 is connected to a water source (not shown) through a water supply path 311. The water supply path 311 may be opened and closed by a water supply valve 312, which is controlled by a controller (not shown).

The wash water stored in the sump 3 is discharged out of the dishwasher through a drainage path 313 and a drainage pump 314.

Meanwhile, the dishwasher 100 further includes a pump 8 for supplying the wash water stored in the sump 3 to the spray arms 711, 713, and 715.

The pump 8 may include a body 82 fixed in the cabinet 1, a sump partition 84 for partitioning the inner space of the body 82 into a first chamber C1 and a second chamber C2, a communication hole 86 formed through the sump partition 84 for allowing the first chamber C1 and the second chamber C2 to communicate with each other therethrough, an introduction part 841 connected between the sump 3 and the first chamber C1, a wash water discharge part 845 provided in the second chamber C2 such that wash water is discharged through the wash water discharge part 845, an impeller 85 provided in the second chamber C2, and a heater assembly H provided in the bottom of the first chamber C1.

The pump 8 is connected to the sump 3 through a connection path 35. The connection path 35 is connected to the lower end of the side of the first storage unit 31 of the sump 3 and to the introduction part 841 of the pump 8.

Since the heater assembly H defines the bottom of the first chamber C1, the pump 8 may simultaneously perform a function of heating wash water and a function of circulating wash water.

The heater assembly H may include a pump heater 83, which is exposed in the first chamber C1 such that the pump heater 83 directly contacts wash water. Alternatively, the heater assembly H may include a pump heater 83, which is provided in a heater housing 833. The heater housing 833 may define the bottom of the first chamber C1 such that the pump heater 83 does not directly contact wash water. Heat may be transferred to the heater housing 833 such that wash water is heated by the heater housing 833. In this case, the heater housing 833 may be made of a conductor, such as a metal, such that thermal energy can be effectively transferred to the wash water.

The impeller 85 moves wash water, introduced from the first chamber C1 into the second chamber C2 through the communication hole 86, to the wash water discharge part 845. The impeller 85 may be rotated by an impeller drive unit 87 provided outside the body 82.

The drive unit 87 may include a motor 871 provided at the top of the second chamber C2 and a rotary shaft 873 of the motor 871*m* which is connected to the impeller 85 through the pump 8.

Meanwhile, referring to FIGS. 1 and 3, the dishwasher may further include a second storage unit 5002 for temporarily storing the wash water discharged from the wash water discharge part 845 of the pump 8 and a main supply path 5001 connected between the wash water discharge part 845 and the second storage unit 5002.

The second storage unit 5002 may be provided in the sump 3. Alternatively, the second storage unit 5002 may be provided separately from the sump 3. In addition, the second storage unit 5002 is provided under the tub 2. The second storage unit 5002 is provided in the lower part of a distribution unit 560, a description of which will follow.

Consequently, the wash water pumped by the pump 8 is temporarily stored in the second storage unit 5002 through the wash water discharge part 845, and is then supplied into the distribution unit 560. Subsequently, the distribution unit 560 supplies the wash water to at least one selected from among a plurality of supply paths 731, 733, and 735.

The first supply path 731 and the third supply path 735 are provided in the upper part of the sump 3 (the upper part of a rotary member 562 provided in the distribution unit 560) in the state in which one side of each of the supply paths 731 and 735 is open. The first supply path 731 and the third supply path 735 are connected respectively to the top arm 715 and the upper arm 711 along the bottom and one side of the tub 2.

In addition, the second supply path 733 is provided in the upper part of the sump 3 (the upper part of the rotary member 562 provided in the distribution unit 560) in the state in which one side of the second supply path 733 is open. The second supply path 733 is connected to the lower arm 713.

The upper arm 711 is rotatably provided at one end of the third supply path 735, and the lower arm 713 is rotatably provided at the second supply path 733.

FIG. 4 is a plan view showing a sump of the present invention. FIG. 5 is a perspective view showing a distribution unit of the present invention. FIG. 6 is a plan view showing the distribution unit of the present invention. Hereinafter, the distribution unit of the present invention will be described.

As shown in FIGS. 4 and 5, the distribution unit 560 includes a cover 550 provided under the tub 2, the cover 550 having a plurality of communication holes 552, 554, and 556 connected to the supply paths 731, 733, and 735 so as to communicate with the spray arms 711, 713, and 715, a rotary member 562 for supplying wash water to at least one of the communication holes 552, 554, and 556, a position determination means 570 for determining the rotational position of the rotary member 562, and a rotary member drive unit 590 for rotating the rotary member 562.

The cover 550 is provided at the top of the sump 3. The communication holes 552, 554, and 556 include a first communication hole 554 connected to the first supply path 731, a second communication hole 556 connected to the second supply path 733, and a third communication hole 552 connected to the third supply path 735.

The communication holes 552, 554, and 556 are selectively opened by the rotary member 562. In other words, the rotary member 562 is provided under the cover 550, which has the communication holes 552, 554, and 556 therein. The rotary member 562 is provided with two or more rotary member openings 564 and 566.

The rotary member openings 564 and 566 may include a first opening 564 and a second opening 566, the sizes of which are different from each other.

When the rotary member 562 is rotated, therefore, the rotary member openings 564 and 566 pass under the communication holes 552, 554, and 556 formed in the cover 550. The rotary member 562 is connected to a drive shaft 592 of the rotary member drive unit 590 such that the rotary member 562 is rotated in one direction. When the rotary member 562 is rotated, the rotary member openings 564 and 566, formed in the rotary member 562, selectively open or close the communication holes 552, 554, and 556 such that wash water is supplied through the open communication holes and such that no wash water is supplied through the closed communication holes.

For example, wash water may be selectively sprayed through at least one selected from among the top arm 715, the upper arm 711, and the lower arm 713 or through a combination of two or more selected from among the top arm 715, the upper arm 711, and the lower arm 713.

A means for determining the rotational position of the rotary member 562 is needed in order to open at least one of the communication holes 552, 554, and 556 by rotating the rotary member 562 such that wash water is supplied. In other words, a means for determining which of the communication holes 552, 554, and 556 is opened and closed by the rotary member openings 564 and 566 is needed such that wash water is sprayed through a desired one of the spray arms 711, 713, and 715.

To this end, the position determination means 570 includes a cam 572 configured to be rotated by the rotary member drive unit 590 at the same phase as the rotary member 562, the cam 572 having a plurality of protrusions 573, 574, and 575, and a switch unit 578 for generating a signal based on the protrusions 573, 574, and 575 in response to the rotation of the cam 572 and transmitting the generated signal to a controller (not shown).

The protrusions 573, 574, and 575 may be arranged along the outer circumference of the cam such that the protrusions 573, 574, and 575 have different protruding lengths. Alternatively, the protrusions 573, 574, and 575 may be arranged along the outer circumference of the cam at different intervals.

As shown in FIG. 6, the protrusions 573, 574, and 575 of the cam 572 may include a first protrusion 573, a second protrusion 574, and a third protrusion 575.

The switch unit 578 is configured to generate a signal in response to the rotation of the cam 572. Specifically, the switch unit 578 includes a body 579 and a signal generator 580 extending from the body so as to be selectively pushed by the protrusions 5 of the cam 572 for generating a signal. When the cam 572 is rotated as the result of rotation of the drive shaft 592, therefore, the signal generator 580 is pushed by the protrusions 573, 574, and 575, to generate a signal.

The time at which the signal generator 580 is pushed may be sensed by the switch unit 578. The rotational positions of the cam 572 and the rotary member 562 may be determined based on the time sensed by the switch unit 578. As a result, the rotary member driving unit 590 may be controlled so as to control the supply of wash water to the spray arms 711, 713, and 715.

FIGS. 7 to 11 are views showing the relationship between the rotary member and the communication holes 552, 554, and 556 of the present invention.

A method of supplying wash water to the spray arms based on the communication between the openings and the communication holes in response to the rotation of the rotary member will be described with reference to FIGS. 7 to 11.

Referring to FIG. 7, the first opening 564 in the rotary member 562 opens the second communication hole 556, the second opening 566 in the rotary member 562 opens the third communication hole 552, and the first communication hole 554 is closed. In this case, wash water is supplied to the lower arm 713 and the upper arm 711.

Referring to FIG. 8, the rotary member 562 and the cam 572 are rotated counter-clockwise. As a result, the first opening 564 of the rotary member 562 opens the first communication hole 554, and the second communication hole 556 and the third communication hole 552 are closed. In this case, wash water is supplied to the top arm 715, but no wash water is supplied to the upper arm 711 or to the lower arm 713.

Referring to FIG. 9, the rotary member 562 and the cam 572 are rotated counter-clockwise. As a result, the first opening 564 in the rotary member 562 opens the first communication hole 554 and the third communication hole 552, and the second opening 566 in the rotary member 562 opens the second communication hole 556. In this case, wash water is supplied to the top arm 715, the upper arm 711, and the lower arm 713.

Referring to FIG. 10, the rotary member 562 and the cam 572 are rotated counter-clockwise. As a result, the first opening 564 in the rotary member 562 opens the third communication hole 552, and the first communication hole 554 and the second communication hole 556 are closed. In this case, wash water is supplied to the upper arm 711.

Referring to FIG. 11, the rotary member 562 and the cam 572 are rotated counter-clockwise. As a result, the first opening 564 in the rotary member 562 opens the second communication hole 556, the second opening 566 in the rotary member 562 opens the first communication hole 554, and the third communication hole 552 is closed. In this case, wash water is supplied to the top arm 715 and the lower arm 713.

Consequently, wash water may be selectively sprayed through at least one selected from among the spray arms 711, 712, and 713 or through a combination of two or more selected from among the spray arms 711, 712, and 713.

Meanwhile, the dishwasher 100 may supply steam to objects to be washed in order to improve the efficiency with which the objects are washed.

The dishwasher according to the present invention may further include a first steam nozzle 42 provided at the door 13 for spraying steam to the objects. Alternatively, the dishwasher according to the present invention may further include a second steam nozzle 43 provided at the rear of the tub 2. Alternatively, although not shown, the dishwasher according to the present invention may further include a steam nozzle provided at the side of the tub 2.

Meanwhile, the dishwasher according to the present invention may further include a docking connector 64 provided in the tub 2 for supplying steam to the first steam nozzle 42, a first steam path 44 for connecting the docking connector 64 to a steam source, and a docking unit 62 connected to the first steam nozzle 42 and selectively connected to the docking connector 64 for receiving steam. In this case, when the door 13 is opened, the docking unit 62 and the docking connector 64 are separated from each other. When the door 13 is closed, the docking unit 62 and the docking connector 64 are connected to each other to define a path along which steam flows. Consequently, steam may be supplied to the first steam nozzle 42, provided in the door 13, regardless of whether the door is opened or closed.

The steam source may be configured variously. In one example, an additional steam generator (not shown) may be provided under the tub, and the first steam path 44 may be connected to the steam generator (not shown) such that steam is supplied to the first steam nozzle 42. In another example, a sump heater (not shown) may be provided in the sump 3, and the first steam path 44 may be connected to one side of the sump 3 such that steam is supplied to the first steam nozzle 42.

In a further example, steam may be supplied using the pump heater 83, provided in the pump 8. The steam generated by the pump heater 83 may be supplied to one end of the first steam path 44, which is connected to the pump 8. Specifically, since the heater assembly H of the pump 8 is provided in the bottom of the first chamber C1, a predetermined amount of wash water is supplied into the first chamber C1, and then the pump heater 83 may be operated to generate steam. A steam discharge port 843 for discharging the steam, generated in the first chamber C1, out of the first chamber C1 may be further provided. The steam discharge port 843 may be connected to the first steam path 44. The steam generated by the pump 8 is supplied to the first steam nozzle 42 via the first steam path 44. The steam is sprayed into the tub.

Meanwhile, the second steam nozzle 43 is connected to a second steam path 45, which is connected to the steam source, such that steam is supplied to the second steam nozzle 43.

Referring back to FIG. 2, the second steam path 45 is connected to the steam source.

The second steam path 45 extends through the lower surface of the tub 2 such that a part of the second steam path 45 is provided under the tub 2. In addition, the second steam path 45 is connected to the second steam nozzle 43.

As previously described, one selected from among the steam generator, the sump heater, which is provided in the sump, and the pump heater, which is provided in the pump, may be used as the steam source.

In the case in which the pump heater 83, provided in the pump 8, is used as the steam source, a second connection path 46 is connected to the steam discharge port 843, which is provided in the first chamber C1 of the pump 8. Alternatively, the second connection path 46 may diverge from the first steam path 44. The divergent part may be provided with a switch valve (not shown) for adjusting the amount of steam that is supplied to the first steam path 44 or the second connection path 46 or for opening and closing the first steam path 44 or the second connection path 46.

Meanwhile, the dishwasher according to the present invention may supply steam to the tub 2 through the spray arms 711, 713, and 715, rather than through the first steam nozzle 42 or the second steam nozzle 43.

Specifically, the steam generated in the first chamber C1 by the heater assembly H may be supplied into the second chamber C2 using the property whereby hot air rises or by driving the impeller 85, and the steam may be supplied and stored in the second storage unit 5002 from the second chamber C2 through the main supply path 5001. In this case, steam may be selectively supplied to at least one of the spray arms 711, 713, and 715 using the distribution unit 560.

The process of spraying steam is identical to the process of spraying wash water described above, and therefore a detailed description thereof will be omitted.

Consequently, the dishwasher according to the present invention may intensively supply steam to the upper rack 23 or the lower rack 25, provided in the tub 2, through the spray arms 711, 713, and 715. For example, in the case in which objects to be washed are placed in the upper rack 23, steam may be supplied through the upper arm 711 and the top arm 715 such that steam is intensively supplied only to the upper rack 23. In the case in which objects to be washed are placed in the lower rack 25, steam may be supplied through at least one selected from among the first steam nozzle 42, the second steam nozzle 43, and the lower arm 713 or through a combination of two or more selected from among the first steam nozzle 42, the second steam nozzle 43, and the lower arm 713 such that steam is intensively supplied only to the lower rack 25.

FIG. 12 is a flowchart showing an example of a method of controlling a dishwasher according to the present invention. FIG. 13 is a flowchart showing an example of a method of spraying steam through spray arms in the method of controlling the dishwasher according to the present invention.

The method of controlling the dishwasher according to the present invention uses an algorithm of spraying steam to dishes that have been washed and rinsed in order to dry the dishes. Since the dishes are dried using steam, it is possible to increase the temperature of the dishes using a small amount of water, thereby reducing energy consumption.

Hereinafter, the method of controlling the dishwasher according to the present invention will be described with reference to FIG. 12.

The method of controlling the dishwasher according to the present invention may include a main washing cycle (S200) of washing objects to be washed, a rinsing cycle (S300) of rinsing the washed objects using wash water, and a drying cycle (S400) of drying the objects after the rinsing of the objects is completed.

The main washing cycle (S200) is a cycle of washing dishes. Wash liquid containing washing detergent dissolved therein is sprayed to the dishes through the spray arms 711, 713, and 715. Meanwhile, in the rinsing cycle (S300), water is sprayed to the dishes through the spray arms 711, 713, and 715 in order to remove the wash liquid from the objects.

The main washing cycle (S200) and the rinsing cycle (S300) may be repeated several times in order to completely remove foreign matter from the objects.

In addition, a pause period during which a wait is performed for a predetermined time such that the foreign matter on the objects is soaked in the sprayed wash liquid so as to be easily separated from the objects may be provided between the main washing cycle (S200) and the rinsing cycle (S300).

Meanwhile, the method of controlling the dishwasher according to the present invention may further include a pre-washing cycle (S100) of spraying a predetermined amount of water to the upper rack 23 and the lower rack 25 through the spray arms 711, 713, and 715 in order to soak the foreign matter on the objects in the water before the main washing cycle (S200). Subsequently, a wait is performed for a predetermined time such that the foreign matter on the objects is soaked in the water. In this case, room-temperature water may be sprayed, or heated water may be sprayed.

Alternatively, in the pre-washing cycle (S100), steam may be sprayed into the tub 2 such that the foreign matter on the objects is wetted. In this case, a high-temperature and high-humidity environment is formed in the tub, with the result that the foreign matter is effectively removed from the objects, thereby improving washing efficiency.

For a general dishwasher, in the drying cycle (S400), heated wash water is sprayed to increase the temperature of the objects, and then the objects are dried using the heat of vaporization of the water on the outer surfaces of the objects, which is generated as the result of the heated objects being cooled. In this method, however, a large amount of water is supplied to the tub through the pump 8 and the spray arms, with the result that water consumption is increased. Furthermore, a large amount of wash water is heated, with the result that power consumption is increased.

In order to solve the above problems, the drying cycle (S400) of the present invention includes a steam spraying step (S430) of spraying steam, received from the steam source, to the objects so as to increase the temperature of the objects.

That is, steam, rather than heated wash water, is sprayed to the objects to increase the temperature of the objects such that the objects are dried using heat of vaporization, which is generated as the result of the heated objects being cooled, and heat exchange between the latent heat of the steam and the objects.

When the dishes are dried as described above, only the water that is necessary to generate steam is consumed, with the result that the amount of water required to dry the objects is considerably reduced. Furthermore, only a small amount of water is heated, with the result that the amount of power used by the heater is reduced, thereby reducing energy consumption.

In addition, since it is not necessary to heat a large amount of water, a small amount of water is heated within a short time, thereby reducing the time for which the drying cycle is performed.

Meanwhile, the drying cycle (S400) of the present invention further includes a steam water supply step (S410) of supplying water to the steam source and a heater operation step (S420) of supplying power to the heater to increase the temperature of the heater. The steam water supply step (S410) and the heater operation step (S420) are performed before the steam spraying step (S430).

At the steam water supply step (S410), water is supplied to the storage unit 31 of the sump or the first chamber C1 through the water supply path 311, and power is supplied to the pump heater 83 to generate steam. Even in the case in which the steam source for generating steam is a steam generator (not shown) or a sump heater (not shown) provided in the sump, the above step may be equally applied.

In addition, the steam water supply step (S410) and the heater operation step (S420) may be performed in reverse order as needed. In order to prevent the heater from being overheated without water, however, the steam water supply step (S410) is generally performed first, after which the heater operation step (S420) is performed.

At the steam spraying step (S430), the impeller 85 is driven in order to supply the steam generated in the first chamber C1 to the spray arms 711, 713, and 715. That is, the steam generated in the first chamber C1 flows to the main supply path 5001 through the second chamber C2. When the impeller 85 is driven in order to increase the pressure at which the steam is sprayed, however, the steam flows through the communication hole 86 between the first chamber and the second chamber, and is then supplied to the main supply path 5001 through the wash water discharge port 845. As a result, the steam sprayed through the spray arms may have a predetermined pressure.

Meanwhile, the rising cycle (S300) of the present invention may further include a final rinsing step (not shown) of spraying room-temperature wash water to the objects in order to rinse the objects.

Here, "room-temperature wash water" means water that is supplied from an external water source or water that is not heated by the heater.

In the drying cycle (S400) of the present invention, steam is sprayed to dry the objects. In the state in which the rinsing cycle (S300) is completed, therefore, the steam is sprayed to the objects to dry the objects using heat of vaporization of the steam. If the temperature of the objects (the dishes) is too high, however, it is not possible to vaporize moisture from the objects using the heat of vaporization of the steam, but water drops may be condensed on the dishes. For this reason, in the final rinsing step, which is performed before the steam spraying step, room-temperature wash water is sprayed to rinse the objects.

Meanwhile, control may be performed such that a pause period is provided for a predetermined time after the rinsing cycle (S300) and before the drying cycle (S400). In the rinsing cycle (S300) of the present invention, when the objects are rinsed using heated wash water, the objects are heated, as in a general dishwasher. The pause period is provided to cool the objects, thereby reducing the temperature of the objects. After the pause period, the steam spraying step (S430) may be performed in the drying cycle to sufficiently reduce the temperature of the dishes such that the thermal energy of the steam is transferred to the dishes.

Meanwhile, the steam spraying step (S430) may be controlled such that steam is sprayed for a predetermined time. As a result, the dishes may be sufficiently heated to a desired temperature within a short time. The desired temperature is the temperature at which moisture on the dishes is vaporized.

Alternatively, the steam spraying step (S430) may be controlled such that steam is intermittently sprayed to the objects. When the steam is intermittently sprayed, spraying of the steam and vaporization of the stem are repeatedly performed, with the result that moisture on the objects is vaporized rapidly. When the steam is intermittently sprayed, however, control is performed such that the initial spraying time is long and spraying times are gradually decreased toward the final spraying time. As a result, in the initial period, the temperature of the dishes rises to a predetermined temperature, whereby it is possible to vaporize moisture on the dishes, and, in the later period, the time during which steam is sprayed is reduced, whereby it is possible to minimize the amount of moisture formed on the dishes.

Meanwhile, the steam spraying step (S430) may include a first steam spraying step of spraying steam through the first steam nozzle 42 or the second steam nozzle 43 and a second steam spraying step of spraying steam through at least one selected from among the spray arms 711, 713, and 715.

Meanwhile, the method of controlling the dishwasher according to the present invention may further include a course/option selection step (S1000) of selecting a predetermined course or option.

At the course/option selection step (S1000), at least one is selected from among a first course, in which the first steam spraying step is performed in the drying cycle (S400), a second course, in which the second steam spraying step is performed in the drying cycle (S400), a third course, in which the first steam spraying step and the second steam spraying step are performed simultaneously, and a fourth course, in which the first steam spraying step and the second steam spraying step are performed sequentially.

That is, when the user selects one from among the first course, the second course, the third course, and the fourth course at the course/option selection step, the dishwasher performs the first steam spraying step and/or the second steam spraying step in the drying cycle (S400) according to the selected course.

Meanwhile, the method of controlling the dishwasher according to the present invention may further include a weight sensing step (S2000) of sensing the weight of the upper rack, in which the objects are placed.

The steam spraying step in the drying cycle (S400) is set such that steam is sprayed through the steam nozzles 42 and 43, provided under the tub 2, or through the lower arm 713. This is because steam is characterized in that it rises.

At the weight sensing step (S2000), the weight of the upper rack 23 is sensed by a weight sensor (not shown) provided at the upper rack 23. When the weight of the upper rack 23 sensed by the weight sensor (not shown) is equal to or greater than a predetermined weight (Y at S3000), control is performed such that steam is sprayed through the upper arm 711 and the top arm 715 (S4200). Controlling the rotary member 562 to be rotated such that steam is sprayed through the upper arm 711 and the top arm 715 has been previously described, and a detailed description thereof will be omitted.

That is, when the weight of the upper rack 23 is equal to or greater than the predetermined weight, both the first steam spraying step and the second steam spraying step are performed.

Meanwhile, when the weight of the upper rack 23 sensed by the weight sensor (not shown) is less than the predetermined weight (N at S3000), steam is sprayed through the steam nozzles or the lower arm 713, but no steam is sprayed through the upper arm 711 or the top arm 715 (S4100). Controlling the rotary member 562 to be rotated such that steam is sprayed through the lower arm 713 has been previously described, and a detailed description thereof will be omitted.

That is, when the weight of the upper rack 23 is less than the predetermined weight, control is performed such that only the first steam spraying step is performed.

Meanwhile, the drying cycle (S400) may include a waiting step (S450) of providing a pause period such that the steam sprayed to the objects is vaporized after the steam spraying step (S430).

At the waiting step (S450), the steam sprayed to the heated objects is vaporized, whereby the objects are dried. At the waiting step (S450), the temperature of the objects, i.e. the dishes, is gradually decreased such that moisture is completely removed from the objects. In addition, the temperature of the dishes is sufficiently decreased such that the user does not burn his/her hands when taking the dishes out of the dishwasher.

Meanwhile, the method of controlling the dishwasher according to the present invention may further include a cooling step (S450) of resupplying water to the steam source in order to prevent the steam source from being heated after the steam spraying step (S430).

In the case in which the steam source is constituted by the sump 3 and the sump heater (not show) or by the pump 8 and the pump heater 83, the method of controlling the dishwasher according to the present invention may further include a drainage step (S460) of discharging residual water from the sump 3 or the pump 8. If the residual water is discharged immediately after the steam spraying step (S430), however, the heater may be overheated, with the result that the heater may be damaged, which may cause a fire.

In order to solve the above problem, the cooling step (S450) is performed. At the cooling step (S450), water is supplied to the steam source to cool the heater, thereby preventing damage to the heater.

At the cooling step (S450), a wait is performed for a predetermined time after water is supplied to the steam source. Specifically, water is supplied into the first storage unit 31 of the sump 3 through the water supply path 311 to cool the sump heater (not shown). Alternatively, the impeller 85, provided in the pump 8, is driven to supply water to the first chamber C1 to cool the pump heater 83.

Subsequently, at the drainage step (S460), the drainage pump 314 is driven such that residual water is discharged from the first storage unit 31 of the sump 3 or the first chamber C1 of the pump 8 through the drainage path 313. The reason for this is that microorganisms will inhabit the residual water, with the result that the residual water will emit a terrible smell and become insanitary, if the residual water is not discharged.

MODE FOR THE INVENTION

Various embodiments have been described in the best mode for carrying out the invention.

INDUSTRIAL APPLICABILITY

The present invention has the effect of providing a dishwasher that is capable of spraying steam through a spray arm and a control method thereof.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A control method of a dishwasher that comprises a tub configured to receive an object, a plurality of spray arms configured to spray wash water to the object, and a steam nozzle configured to spray steam to the object, the control method comprising:

washing the object;

rinsing the washed object using wash water; and drying the rinsed object based on completion of rinsing the object, wherein drying the object comprises:

supplying water to a steam source, supplying power to a heater configured to provide heat to the steam source to generate steam, spraying steam received from the steam source to the object to increase a temperature of the object, and resupplying water to the steam source to prevent overheating of the steam source after spraying steam.

2. The control method according to claim 1, wherein rinsing the washed object comprises spraying room-temperature wash water to the object.

3. The control method according to claim 1, wherein rinsing the washed object comprises rinsing the object using heated wash water, and wherein drying the object further comprises waiting for a predetermined time after rinsing the object using heated wash water.

4. The control method according to claim 1, wherein spraying steam is performed for a predetermined time.

5. The control method according to claim 1, wherein spraying steam comprises spraying steam intermittently.

6. The control method according to claim 1, wherein drying the object further comprises providing a pause period after spraying steam, and vaporizing the steam sprayed to the object.

7. The control method according to claim 1, wherein the steam source comprises a sump configured to store wash water, and a sump heater provided in the sump.

8. The control method according to claim 1, wherein the steam source comprises a sump configured to store wash water, a pump configured to supply wash water stored in the sump to the plurality of spray arms, and a pump heater provided in the pump.

9. The control method according to claim 1, wherein resupplying water to the steam source comprises waiting for a predetermined time after providing water to the steam source.

10. The control method according to claim 1, wherein drying the object further comprises discharging water from the steam source after resupplying water to the steam source.

11. The control method according to claim 1, wherein spraying steam comprises:

spraying steam through the steam nozzle; and spraying steam through at least one of the plurality of spray arms.

12. The control method according to claim 11, further comprising selecting a predetermined course or option that includes at least one of:

a first course for spraying steam through the steam nozzle, a second course for spraying steam through at least one of the plurality of spray arms, a third course for spraying steam simultaneously through the steam nozzle and through at least one of the plurality of spray arms, and a fourth course for spraying steam sequentially through the steam nozzle and through at least one of the plurality of spray arms.

13. The control method according to claim 11, further comprising:

sensing a weight of an upper rack that is disposed in the tub and configured to receive the object; and spraying steam through the steam nozzle and through at least one of the plurality of spray arms based on the weight of the upper rack being greater than equal to a predetermined weight.

14. The control method according to claim 13, further comprising spraying steam only through the steam nozzle based on the weight of the upper rack being less than the predetermined weight.

* * * * *